US012072102B2

(12) United States Patent
Andersson et al.

(10) Patent No.: US 12,072,102 B2
(45) Date of Patent: Aug. 27, 2024

(54) FUEL NOZZLE WITH MULTIPLE AIR PASSAGES

(71) Applicant: Siemens Energy Global GmbH & Co. KG, Munich (DE)

(72) Inventors: Mats Andersson, Stockholm (SE); Rickard Heinefeldt, Finspong (SE); Olle Lindman, Finspong (SE); Magnus Persson, Svärtinge (SE); Patrik Jaerling, Linköping (SE); Atanu Kumar Kundu, Linköping (SE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/128,589

(22) Filed: Mar. 30, 2023

(65) Prior Publication Data

US 2023/0366552 A1 Nov. 16, 2023

(30) Foreign Application Priority Data

May 12, 2022 (EP) ..... 22172962

(51) Int. Cl.
*F23R 3/28* (2006.01)

(52) U.S. Cl.
CPC ..... *F23R 3/28* (2013.01)

(58) Field of Classification Search
CPC ..... F23R 3/28; F23R 3/286; F23R 3/346
See application file for complete search history.

(56) References Cited

U.S. PATENT DOCUMENTS

2006/0156730 A1 7/2006 Dinu
2010/0008179 A1 1/2010 Lacy
2010/0170253 A1* 7/2010 Berry ..... F23R 3/286 60/742
2011/0289928 A1* 12/2011 Fox ..... F23R 3/34 60/740
2012/0192565 A1* 8/2012 Tretyakov ..... F02C 7/22 60/737

(Continued)

FOREIGN PATENT DOCUMENTS

EP 3436746 B1 1/2020
EP 3472518 B1 11/2020

(Continued)

OTHER PUBLICATIONS

Beck, Machine Translation of WO-2019020350-A1 (2019), retrieved on Jan. 13, 2024 from Espacenet.com at https://translationportal.epo.org/emtp/translate/?ACTION=description-retrieval&COUNTRY=WO&ENGINE=google&FORMAT=docdb&KIND=A1&LOCALE=en_EP&NUMBER=2019020350&SRCLANG=de&TRGLANG=en (Year: 2019).*

(Continued)

*Primary Examiner* — Jason H Duger

(74) *Attorney, Agent, or Firm* — Wolter Van Dyke Davis, PLLC

(57) ABSTRACT

A fuel nozzle for use in a combustion arrangement of a gas turbine includes a main body extending from a cold side to an opposite hot side and at least five air passages arranged next to each other extending from the cold side towards the hot side. A fuel distribution chamber is arranged within the main body next to the cold side, wherein the air passages cross the fuel distribution chamber separated by passage walls. To inject fuel into the air passages, fuel holes are arranged within the passage walls.

16 Claims, 3 Drawing Sheets

(56) References Cited

U.S. PATENT DOCUMENTS

| | | | | |
|---|---|---|---|---|
| 2012/0198854 | A1* | 8/2012 | Schilp | F23R 3/06 60/755 |
| 2015/0285501 | A1 | 10/2015 | DiCintio | |
| 2017/0370589 | A1 | 12/2017 | Berry | |
| 2020/0378604 | A1* | 12/2020 | Roh | F23R 3/286 |

FOREIGN PATENT DOCUMENTS

| | | | |
|---|---|---|---|
| EP | 3479025 | B1 | 11/2021 |
| WO | 2019020350 | A1 | 1/2019 |
| WO | WO-2019020350 | A1 * | 1/2019 |

OTHER PUBLICATIONS

European search report dated Oct. 25, 2022 for corresponding European patent application No. EP22172962.7.

* cited by examiner

FUEL NOZZLE WITH MULTIPLE AIR PASSAGES

CROSS REFERENCE TO RELATED APPLICATIONS

This application claims the benefit of European Application No. EP22172962 filed 12 May 2022, incorporated by reference herein in its entirety.

FIELD OF INVENTION

The invention generally relates to a fuel nozzle, which is intentionally used at a combustion arrangement of a gas turbine as a second (or later) stage fuel injector downstream to a primary burner. Thereby the fuel nozzle enables the introduction of fuel and air into a secondary combustion zone.

BACKGROUND OF INVENTION

Combustion arrangements of gas turbines comprise a combustion chamber with at least one primary burner arranged at the head end of the combustion chamber. This defines a primary combustion zone adjacent to the burner within the combustion chamber. In regular embodiments a transition is arranged downstream the combustion chamber guiding the combustion gases from the combustion chamber to an expansion turbine.

To minimize the overall production of NOx emissions common embodiments of combustion arrangements comprise downstream to the primary combustion zone a further secondary combustion zone. This is enabled by the arrangement of secondary stage fuel nozzles within the transition. Examples of these fuel nozzles are presented in EP 3479025 B 1, EP 3472518 B1 and EP 3436746 B1. All these kind of fuel nozzles are having one central air passage. The air is guided from outside of the transition through the fuel nozzle into the transition. At the cold side of the fuel nozzle in general a fuel distribution is attached injecting fuel into the air passage.

To optimize the function of the fuel nozzles different shapes to introduce the mixture of air and fuel into the transition are known. To increase the depth of the air and fuel stream into the transition and to cool the fuel nozzle, solutions with a double wall arrangement are also used.

It is further known from the state of the art, e.g. US2020/0378604A1 to use a fuel nozzle having at the side facing away from the combustion chamber a closing plate with a number of mixing passages. With this solution, the mixing of fuel within the air could be improved.

Even if almost no improvement seems to be possible, there is still a need to reduce the formation of NOx emissions further.

SUMMARY OF INVENTION

The task is solved by an inventive embodiment of a fuel nozzle and an inventive combustion arrangement. Advantageous embodiments are subject of the subclaims.

The generic fuel nozzle is intentionally used in a combustion arrangement. First, it is not relevant which kind of combustion arrangement is given and for which purpose the combustion arrangement is used.

But the implementation of the fuel nozzle is in particular useful at a combustion arrangement of a gas turbine. Here, the gas turbine comprises as usual a compressor, a combustion arrangement and an expansion turbine.

The generic combustion arrangement comprises at least one combustion chamber with at least one primary burner arranged at the head end of the combustion chamber. This defines a primary combustion zone within the combustion chamber adjacent to the primary burner. The advantage embodiment of the combustion arrangement makes use of at least one fuel nozzle as a second stage fuel injector arranged downstream of the primary combustion zone. Thereby the fuel nozzle enables a second stage combustion with a secondary combustion zone.

In this arrangement it is further advantageous if the combustion arrangement comprises further a transition, which is arranged downstream of the combustion chamber. Here, the at least one fuel nozzle is arranged within the transition. Preferably, several fuel nozzles are arranged circumferentially distributed.

The fuel nozzle comprises a main body extending from a cold side to an opposite hot side. The hot side is located at the combustion arrangement towards the combustion zone inside the combustion arrangement. The opposite cold side is facing away from the combustion zone and is located outside the combustion arrangement.

To enable the stream of air and fuel through the fuel nozzle a generic fuel nozzle comprises an air passage. Instead of a single air passage the solution makes use of a bunch of air passages arranged next to each other and enabling the stream of air from the cold side to the hot side. Here, it is required to implement at least five air passages. It is advantage if the fuel nozzle comprises at least ten air passages arranged next to each other.

To enable the introduction of fuel into the air passages at least one fuel distribution chamber is required. Therefore, the air passages cross the fuel distribution chamber, thereby defining a passage wall dividing the air passage from the fuel distribution chamber. Preferably each of the air passage has a surrounding passage wall. But it is also possible, that air passages esp. at the outer side are only partly crossing the fuel distribution chamber and the passage wall only extends partly in circumferential direction (related to the respective air passage). The injection of fuel into the air passages is enabled by the arrangement of fuel holes into the passage walls.

First, it is not required, that a fuel hole is arranged within each passage wall. But at least half of the existing air passages needs to comprise at least one fuel hole inside the passage wall. Advantageously a fuel hole is arranged within each of the passage walls.

The mixing of the fuel within the air is improved with the bunch of air passages. This leads further to an improved combustion within the combustion arrangement. As result it is further possible to achieve reduced NOx emission compared to a combustion arrangement using a generic fuel nozzle.

At the ends of the air passages facing the cold side some distance between the air passages is required, at least to enable the fuel flow in the fuel distribution chamber. At the opposite hot side of the respective air passages, it is advantageous if the distance between the separate air passages is reduced to enable a joint flow of the air passing the air passages without adverse recirculation at the hot side between the air passages. To adapt the arrangement of the ends of the air passages at the cold side to the arrangement of the ends of the air passages facing the hot side it is advantage if the single air passages follow a bend or inclined curve towards a center axis of the fuel nozzle on their way from the cold side towards the hot side.

Here, it could be sufficient if the bended/inclined course is given only over a portion of the length of the respective air passage, especially at the hot side.

Next, it is obvious, that the center axis is already within an air passage in the center of the fuel nozzle and has therefore preferred a straight course. The air passages having a greater distance to the center axis at the cold side needs to be bended/inclined more than those closer to the center axis.

The center axis is extending from the cold side to the hot side in the middle of the fuel nozzle and/or in the middle of the bunch of air passages.

To achieve a jointly stream of air and fuel without any swirl between the single streams from the single air passages and to reduce the size of the fuel nozzle it is advantage if the air passages are shaped and arranged with their ends facing the hot side according to a honeycomb pattern. It is not required, that the end of each single air passage facing the hot side is exactly shaped as regular hexagon. Relevant is an arrangement of the air passages with their ends in a pattern close to each other with a minimum remaining space between adjacent air passages.

A further improvement of the mixing of air and fuel could be achieved with the advantage arrangement of turbulators within the air passages.

First, it is not relevant where these are located and how they are shaped. The purpose is the generation of a micro turbulence inside the air passages. A preferred design has a triangular shape with a tip extending into the air passage at the end of the turbulator facing the hot side.

Next, it is not required to have at least one turbulator in each of the air passages. But, advantageously at least in those air passages comprising a fuel hole inside the respective passage wall should be equipped with a turbulator. Preferably each of the air passages comprise one turbulator.

Due to the fact, that advantageously the ends of the air passages facing the hot side is shaped with a honeycomb pattern and that at the cold side the air passages are arranged with some more space with a for example circular shape it is further advantage to arrange the turbulator close to the cold side. Here, it is further preferred to arrange the turbulators on the passage walls.

To benefit from the function of the turbulator in the best way it is further advantage to arrange the fuel holes at the side facing the hot side relative to the respective turbulators.

Next, it is preferred that the turbulators and the fuel holes are located at the same circumferential position within/at the respective air passage.

It is further advantage to arrange the fuel hole close to the respective turbulator. Here, the distance from the turbulator to the fuel hole should not extend the height of the respective turbulator. The height is defined as dimension of the turbulator from the passage wall extending into the air passage. It is in particular advantageous if the distance between the turbulator and the respective fuel hole is less than 0.5 times the height of the turbulator.

To enable a jointly stream of mixed air and fuel from the bunch of air passages into the combustion zone without swirls between the single streams preferably the fuel nozzle comprises further an air chamber arranged within the main body. The streams form the single air passages should pass the air chamber into the combustion zone. Therefore, the air chamber is arranged following to the ends of the air passages facing the hot side. Next the air chamber is open to the hot side. This solution is further beneficial due to the fact, that the cross section of the air chamber could be chosen equal to the sum of the cross sections of the single air passages. Without dividing walls, as given at the single air passages, the overall size cross to the center axis could be reduced to the minimum needs.

With the advanced curved course of the air passages with the preferred arrangement of the air chamber between the air passages and the hot side it is possible that all air passages end at one common plane. But it is preferred that the surrounding walls of the single air passages end each nearly at a plane cross to the course of the respective air passage.

To enable a cooling of the fuel nozzle at the hot side it is advantage to arrange an annular air channel within the main body surrounding the air chamber. Here, a gap from the air channel into the air chamber is necessary, which should be arranged close to the hot side. A flow of cooling air through the air channel enables a cooling of the boundary wall around the air chamber at the hot side.

To increase the penetration of the stream of mixed air and fuel into the combustion zone advantageously the air channel has in a cross section a shape which is slanted relative to the center axis of the fuel nozzle respectively the bunch of air passages pointing towards the hot side. This leads to a similar velocity of the annular stream of cooling air as the stream of mixed air and fuel from the air passages crossing the air chamber.

To enable the flow of air through the air channel it is advantage to arrange at least one air inlet at the outer side of the main body which is connected with the air channel. Preferably a few air inlets are arranged at the outer side of the main body in connection with the air channel.

To enable a fuel supply to the fuel distribution chamber advantageously the fuel nozzle comprises a fuel connection arranged at the main body at the side facing the cold side.

The inventive fuel nozzle enables an inventive combustion arrangement. The generic combustion arrangement comprises a combustion chamber with at least one burner arranged at the upstream end of the combustion chamber. This defines a primary combustion zone at the outlet of the burner within the combustion chamber. To enable an efficient combustion and thereby limiting the creation of NOx at least one fuel nozzle is arranged downstream of the primary combustion zone. The fuel nozzle enables a secondary combustion zone. The inventive solution makes use of an inventive fuel nozzle.

Depending on the size of the combustion arrangement and the usage, in particular at a gas turbine, advantageously downstream of the combustion chamber a transition is arranged to guide the hot combustion gases further downstream of the combustion chamber. Here, the fuel nozzle is preferably located at the transition.

To enable a homogeneous combustion the combustion arrangement preferably comprises at least four fuel nozzles which are distributed in circumferential direction at the combustion chamber or the transition.

BRIEF DESCRIPTION OF THE DRAWINGS

The following figures shows an exemplary combustion arrangement and an example for an inventive fuel nozzle.

DETAILED DESCRIPTION OF INVENTION

Figure 1:
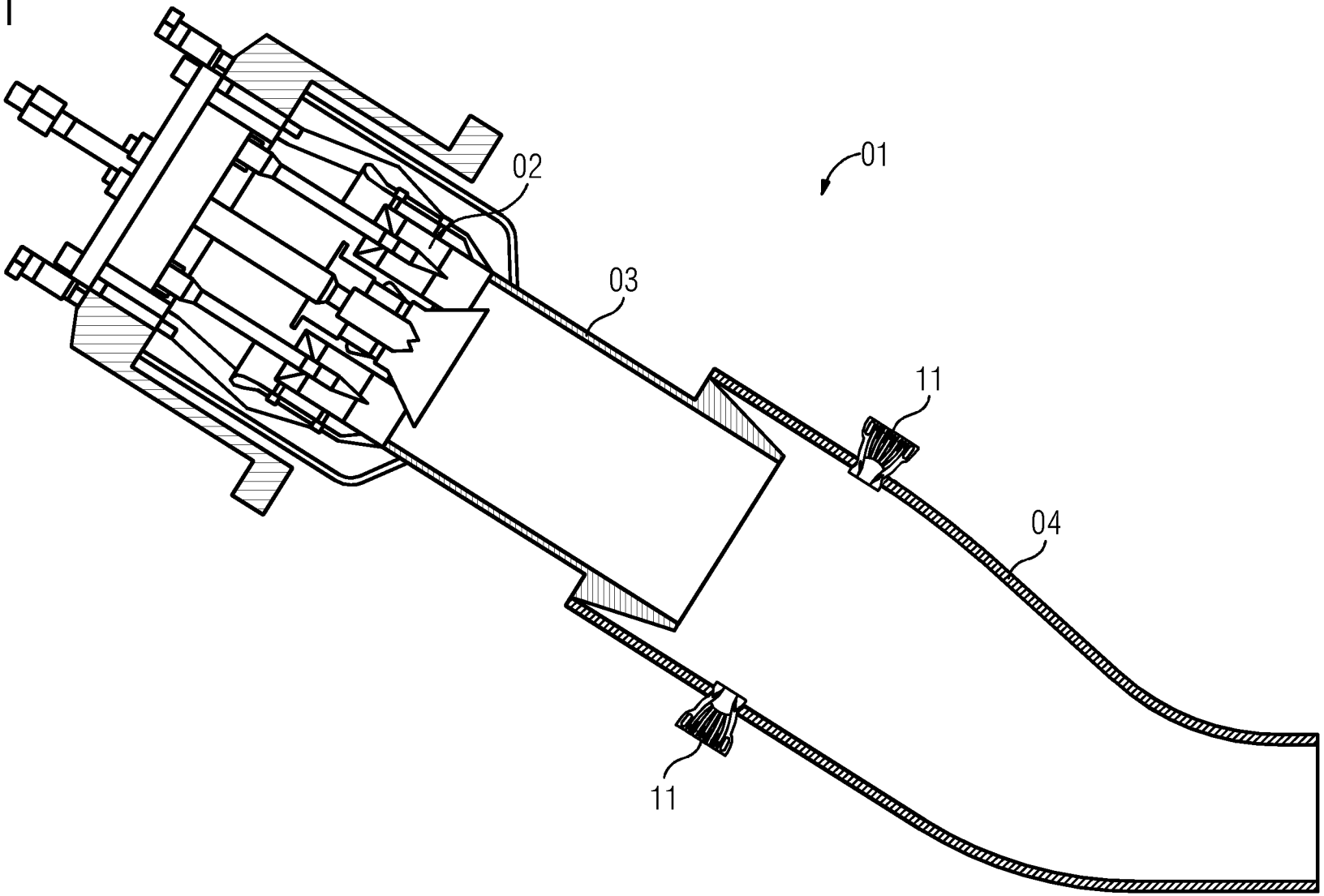
FIG. 1 presents schematically an example for a combustion arrangement comprising an inventive fuel nozzle.

In FIG. 1 an exemplary embodiment of an inventive combustion arrangement 01 is shown. This comprises a combustion chamber 03 with a burner 02 arranged at the upstream end of the combustion chamber 032. In operation this leads to a primary combustion zone within the combustion chamber 03 next to the burner 02. Downstream of the combustion chamber 03 a transition 04 is arranged to guide the hot combustion gases.

Within the transition 04 a number of fuel nozzles 11 are arranged, which enable a further combustion of fuel in a secondary combustion zone within the transition.

Figure 2:
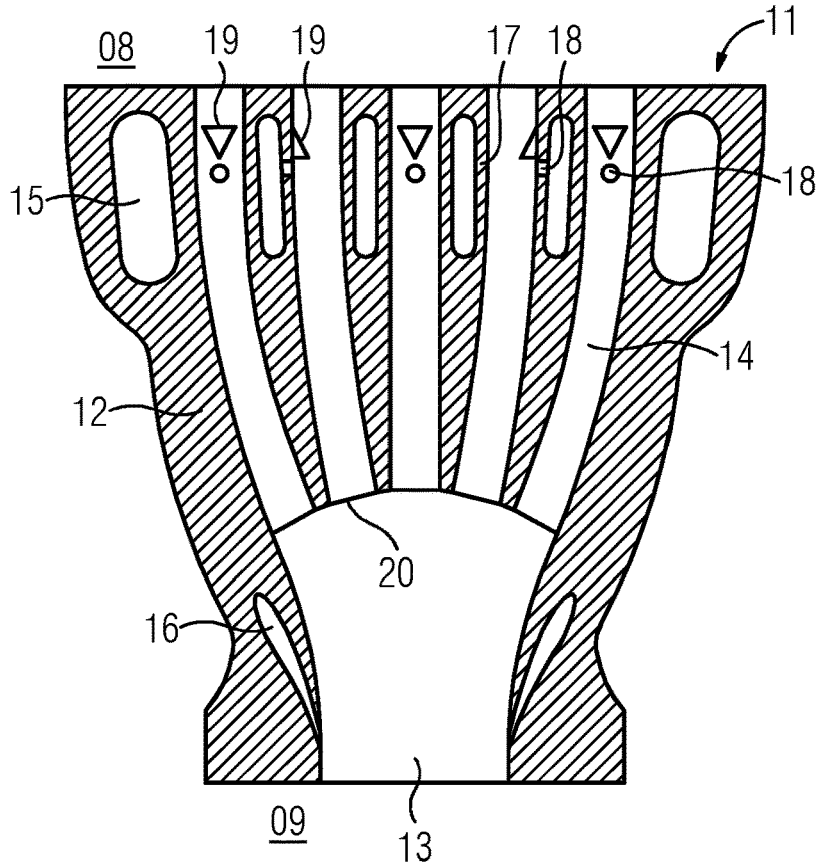
FIG. 2 shows a longitudinal section through the exemplary fuel nozzle.

In FIG. 2 an exemplary embodiment of an inventive fuel nozzle 11 is shown in a longitudinal section. Used at the combustion arrangement the upper side is the cold side 08 at the fuel nozzle 11 facing away from the secondary combustion zone. The lower side in the figure is oriented towards the secondary combustion zone and is therefore the hot side 09.

The fuel nozzle 11 comprises a main body 12 with a bunch of air passages 14 extending from the cold side 08 towards the hot side 09. In this embodiment it is intended, that the air passages 14 opens into an air chamber 13 arranged in the main body 12 between the air passages 14 and the hot side 09. To achieve one jointly stream from the fuel nozzle 11 into the transition 04 the single air passages 14 have a curved course from the cold side 08 up to the air chamber 13, wherein the central air passage 14 goes straight along a centerline of the fuel nozzle 11, wherein those with a bigger distance to the centerline are more curved towards the center.

Figure 3:
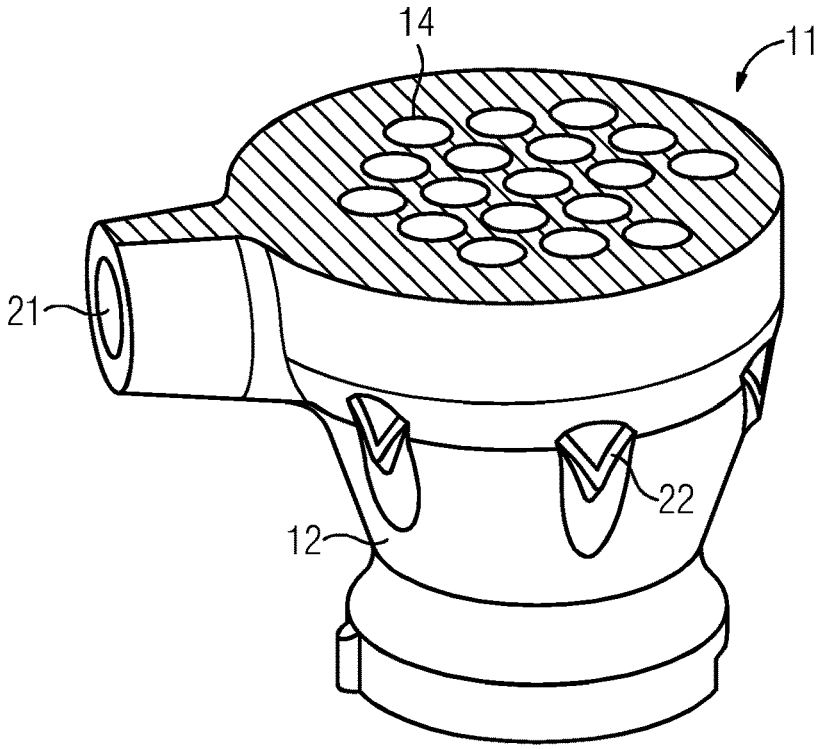
FIG. 3 shows an isometric view at the fuel nozzle.

To enable a minimized distance between the air passages 14 the shape of the cross section of each of the air passages 14 changes from the cold side 08 towards the hot side 09. At the cold side the air passages 14 have a circular cross section. This could be seen best in FIG. 3. But at their end at the air chamber 13 the air passages 14 have a hexagonally cross section and are therefore arranged similar to a honeycomb (not shown here).

Figure 4:
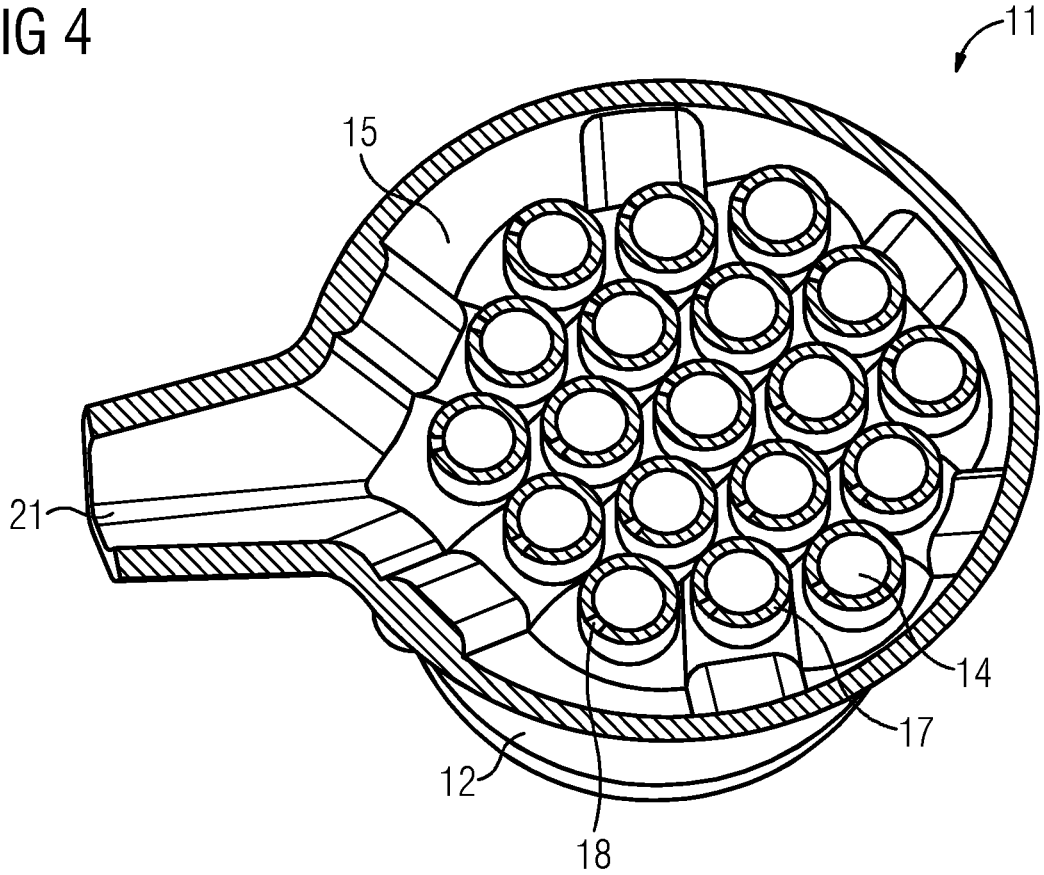
FIG. 4 show a transverse section through the fuel nozzle.

Further shown in the FIG. 2 is the arrangement of a fuel distribution chamber 15 close to the cold side 08 within the main body 12. The air passages 14 cross the fuel distribution chamber 15 and accordingly each air passage 14 is separated from the fuel distribution chamber 15 with a respective passage wall 17. This could also be seen best in FIG. 4.

To enable a supply of fuel to the fuel distribution chamber 15 a fuel pipe 21 is attached to the main body 12.

To inject fuel into the air stream in the air passages 14 within each passage wall 17 one fuel hole 18 is arranged. The position in circumferential direction in respect to the respective air passage 14 of these fuel holes 18 differ between the different air passages 14 to avoid an identical flow through all the air passages 14.

Next, in this embodiment upstream of each fuel hole 18 a turbulator 19 is arranged at the passage wall 17 extending into the respective air passage 14. Thereby the mixing of the fuel into the air is enhanced.

To increase the penetration depth of the air-fuel stream from the fuel nozzle 11 into the transition 04 and also to achieve some cooling effect at the hot side 09 of the fuel nozzle 11, in this embodiment an annular air channel 16 surrounding the air chamber 13 is arranged. This air channel 16 opens with a gap into the air chamber 13 close to the hot side 09. By its cross shape an air stream is achieved shielding the air-fuel stream from the air passages 14. To supply the cooling/shielding air to the air channel 16 there are a few air inlets 22 arranged at the outer side of the main body 12.

The invention claimed is:

1. A fuel nozzle for use in a combustion arrangement, comprising:

a main body extending from a cold side to an opposite hot side, and at least five air passages arranged next to each other extending from the cold side towards the hot side, and a fuel distribution chamber surrounding the air passages next to the cold side, wherein the air passages cross the fuel distribution chamber, wherein passage walls separate the air passages from the fuel distribution chamber, wherein fuel holes are arranged within the passage walls, wherein the air passages define respective flow axes, and the respective flow axes are, at least over a portion, curved and/or inclined towards a center axis of the fuel nozzle from the cold side towards the hot side, and wherein the air passages are configured to cause flows emanating therefrom to converge on each other.

2. The fuel nozzle according to claim 1, wherein turbulators are arranged within the air passages.

3. The fuel nozzle according to claim 2, wherein the turbulators are arranged on the passage walls; and/or wherein the fuel holes are arranged closer to the hot side relative to the turbulators; and/or wherein within a respective air passage of the air passages a respective fuel hole of the fuel holes is arranged at a same circumferential position as a respective turbulator of the turbulators.

4. The fuel nozzle according to claim 2, wherein within a respective air passage of the air passages a distance from a respective turbulator of the turbulators to a respective fuel hole of the fuel holes is less than a height of the respective turbulator extending into the air passage.

5. The fuel nozzle according to claim 1, wherein each passage wall has one fuel hole of the fuel holes and/or within each air passage one turbulator is arranged.

6. The fuel nozzle according to claim 1, further comprising:

an air chamber arranged within the main body open to the hot side.

7. The fuel nozzle according to claim 6, wherein an annular air channel surrounds the air chamber and comprises an opening into the air chamber, wherein the opening is arranged closer to the hot side than to the cold side.

8. The fuel nozzle according to claim 7, wherein the annular air channel is slanted relative to the center axis of the fuel nozzle pointing towards the hot side.

9. The fuel nozzle according to claim 7, wherein at least one air inlet is arranged at an outer side of the main body and connected with the annular air channel.

10. The fuel nozzle according to claim 1, wherein at least one fuel connection is arranged at the main body and connected with the fuel distribution chamber.

11. A combustion arrangement, comprising:

a burner, and a combustion chamber, wherein a primary combustion zone is located adjacent to the burner within the combustion chamber, and at least one fuel nozzle according to claim 1 arranged downstream of the primary combustion zone.

12. The combustion arrangement according to claim 11, further comprising:

a transition arranged downstream the combustion chamber, wherein the fuel nozzle is arranged within the transition.

13. The combustion arrangement according to claim 11, wherein the at least one fuel nozzle according to claim 1 comprises at least four fuel nozzles that are distributed in circumference.

14. The fuel nozzle according to claim 1, wherein the combustion arrangement comprises a gas turbine.

15. The fuel nozzle according to claim 1, wherein the at least five air passages comprises at least ten air passages arranged next to each other extending from the cold side towards the hot side.

16. The fuel nozzle according to claim 4, wherein the distance from the respective turbulator to the respective fuel hole is less than 0.5 times the height of the respective turbulator extending into the air passage.

* * * * *